United States Patent [19]

Bos

[11] Patent Number: 4,672,714

[45] Date of Patent: Jun. 16, 1987

[54] DOOR HINGE FOR MOTOR VEHICLES OR THE LIKE

[75] Inventor: Frans Bos, Kungälv, Sweden

[73] Assignee: AB Volvo, Goteborg, Sweden

[21] Appl. No.: 853,047

[22] Filed: Apr. 17, 1986

[30] Foreign Application Priority Data

Apr. 26, 1985 [SE] Sweden ..... 8502044

[51] Int. Cl.[4] ..... E05D 11/08

[52] U.S. Cl. ..... 16/262

[58] Field of Search ..... 16/260, 261, 262, 263, 16/264, 266, 268, 270, 267, 271, 380, 387; 296/146

[56] References Cited

U.S. PATENT DOCUMENTS

| | | | |
|---|---|---|---|
| 590,873 | 9/1897 | Arnold | 16/382 |
| 1,129,877 | 3/1915 | Lomason . | |
| 1,721,288 | 7/1929 | Thirty | 16/273 |
| 2,138,523 | 11/1938 | Haberstump | 296/146 |
| 2,365,378 | 12/1944 | Benson . | |
| 4,383,478 | 5/1983 | Jones | 16/273 |

FOREIGN PATENT DOCUMENTS

| | | | |
|---|---|---|---|
| 515329 | 8/1954 | Belgium | 16/270 |
| 1953735 | 5/1971 | France . | |
| 2418855 | 9/1979 | France . | |
| 2106587 | 4/1983 | United Kingdom . | |

*Primary Examiner*—M. Jordan

*Attorney, Agent, or Firm*—Young & Thompson

[57] ABSTRACT

The invention relates to a door hinge for motor vehicles or the like, comprising two hinge halves which are pivotally joined to each other by means of a substantially cylindrical pivot pin. The first hinge half consists of a C-bracket, holding between its legs the pivot pin. The second hinge half is provided with a channel for receiving the pivot pin. According to the invention, the second hinge half consists of a bracket portion and a clamping member, which is releasably joined to the bracket portion by means of at least one fastener. The facing surfaces of the bracket portion and the clamping member define together the channel for the pivot pin when these parts are connected by screws to each other.

2 Claims, 3 Drawing Figures

DOOR HINGE FOR MOTOR VEHICLES OR THE LIKE

The invention relates to a door hinge for motor vehicles or the like comprising two hinge halves, which are pivotally connected to each other by means of an essentially cylindrical pivot pin, the first hinge half comprising a C-bracket, between the legs of which the pivot pin is permanently mounted, the second hinge half consisting of a bracket portion and a clamping member, which by means of at least one fastener is releasably joined to the bracket portion, said bracket portion and clamping member being provided with facing and partially abutting surfaces and defining together a channel for receiving the pivot pin.

Hinges of the above mentioned type are generally used to hang doors in motor vehicles or the like. One hinge half is fixed to the door and the other to the door post. When mounting the two hinge halves, which normally cannot be separated, the door is fitted or adjusted in relation to the surrounding vehicle components. If the door must be removed later, it is necessary, when using the previously known hinges, to remove one of the hinge halves from the door or the door post. This destroys the adjustment of the door in relation to the surrounding components and when the door is rehung, a readjustment must be made.

When manufacturing and repairing motor vehicles, it is often desirable to be able to remove one or more of the doors to improve access to the interior of the vehicle, for example when installing or replacing interior fittings. This has, however, not been possible when using previously known hinge types, as stated above.

The purpose of the present invention is to achieve a hinge which makes it possible to separate the two hinge halves from each other and reunite them later, thereby rehanging the door in its adjusted position without any further steps being required. This is made possible according to the invention by virtue of the fact that the facing surfaces of the bracket portion and the clamping member are mirror-symmetrical to each other and each comprise a substantially semicylindrical recess, said recesses forming the channel for the pivot pin, said pivot pin comprising a fixed pin and a rotatable but axially non-displaceable sleeve surrounding the pin and adapted to be securely clamped in the chapnel when the bracket portion and the clamping member are joined to each other.

The invention will be described in more detail below with reference to the accompanying drawing, which shows one embodiment of the invention.

Figure 1:
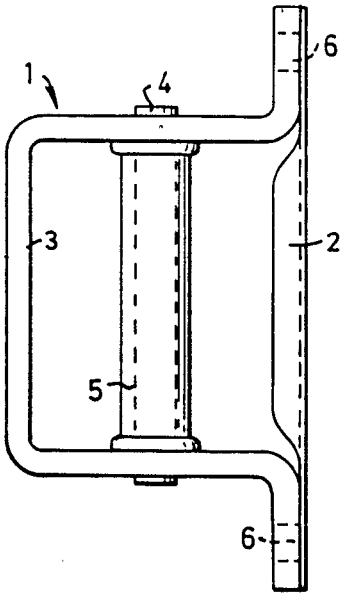
FIG. 1 is a side view of a first hinge half.

FIG. 1 shows a first hinge half. The first hinge half 1 comprises a mounting plate 2, a C-bracket 3, a pivot pin 4 and a sleeve 5. The mounting plate 2 is provided with through holes 6 for bolts (not shown), by means of which the mounting plate 2 is mounted on a door or a door post. The C-bracket 3 is fixed to the mounting plate 2 by means of the free ends of the C-bracket legs. The pivot pin 4 is mounted between the legs of the C-bracket 3 and is preferably rigidly connected to the legs. The sleeve 5 is rotatably journalled on the pivot pin 4 and is held between the legs of the C-bracket 3 in such a way that essentially no axial movement is possible between the sleeve 5 and the legs of the C-bracket 3.

Figure 2:
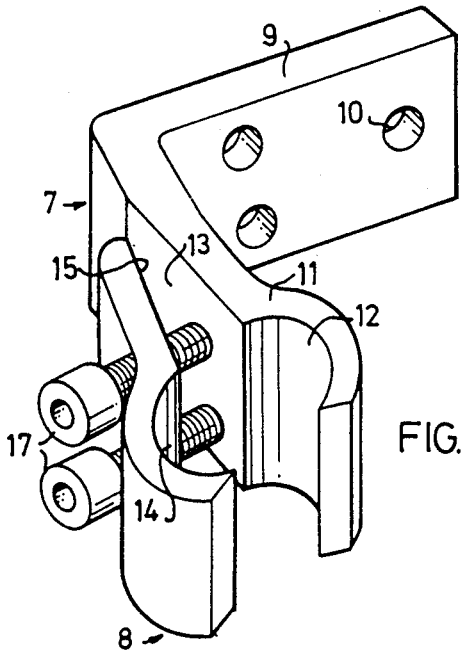
FIG. 2 is a perspective view of a second hinge half for cooperation with the first hinge half in FIG. 1.

FIG. 2 shows the second hinge half of the hinge according to the invention. The second hinge half comprises a bracket portion 7 and a clamping member 8 which is separate from the bracket portion 7. The bracket portion 7 comprises a mounting plate 9 with through holes 10 for bolts (not shown), by means of which the mounting plate 9 can be fixed to a door post or a door, and an arm 11 extending from the mounting plate 9. The arm 11 has in the vicinity of its free end a substantially semicylindrical recess 12, the longitudinal axis of which is substantially vertical and which extends across the entire width of the arm 11. Next to the recess 12, the arm 11 has a flat surface 13, included in a plane which extends through the longitudinal axis of the semicylindrical recess 12.

The clamping member 8 has in the vicinity of one end a semicylindrical recess 14 with the same dimensions as the semicylindrical recess 12 in the arm 11. Next to the semicylindrical recess 14, the clamping member 8 has a flat surface 15, which lies in a plane extending through the longitudinal axis of the semicylindrical recess 14 and which has essentially the same dimensions as the flat surface 13 on the arm 11. The clamping member 8 is also provided with two through holes 16 to freely receive bolts 17, and the arm 11 is provided with two threaded holes 18 into which the bolts 17 can be screwed.

Figure 3:
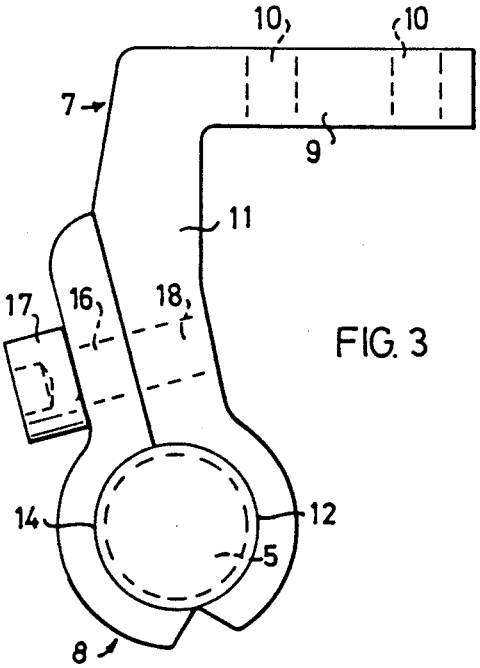
FIG. 3 is a plan view from above of the second hinge half according to FIG. 2.

FIG. 3 shows the second hinge half 7,8 in the position which it assumes when it is joined to the first hinge half 1. The bolts 17 are in this case tightened down, so that the flat surfaces 13 and 15 on the arm 11 and the clamping member 8, respectively, engage each other. The sleeve 5 surrounding the pivot pin 4 is thus held tightly in the substantially cylindrical channel formed by the two facing semicylindrical recesses 12 and 14 in the arm 11 and the clamping member 8, respectively. The pivot pin 4 is in this position freely rotatable in the sleeve 5 which is held tightly in the second hinge half 7,8. The hinge can thus perform its function of allowing a door to swing relative to a door post on which the door is hung.

If the door is to be temporarily removed, to improve access to the interior of the vehicle for assembly or repair for example, the two bolts 17 are unscrewed so that the clamping member 8 can be moved away from the arm 11. The sleeve 5 is thus released and can be removed from the channel formed by the semicylindrical recesses 12 and 14. This means that the first hinge half 1 is released from the second hinge half 7,8 so that the door can be removed.

When rehanging the door, the sleeve 5 is inserted into the channel formed by the recesses 12 and 14, and the bolts 17 are then tightened, so that the sleeve 5 is clamped in the channel. The semicylindrical recesses 12 and 14, which form the channel, assure that the sleeve 5, after reassembly, will assume the same position as it had before removal of the door. No readjustment or fitting of the door is required.

The invention is not limited to the example described above. Rather, changes can be made within the scope of the following patent claims. For example, the sleeve 5 can be eliminated and the pivot pin 4 journalled directly in the channel formed by the semicylindrical recesses 12 and 14, which must in this case be dimensioned so that when the bolts 17 are tightened to bring the flat surfaces 13 and 15 into face-to-face contact, the desired play will be provided between the recesses 12 and 14, respectively, and the pivot pin 4.

I claim:

1. Door hinge for motor vehicles or the like comprising two hinge halves which are pivotally connected to each other by means of an essentially cylindrical pivot pin, the first hinge half comprising a C-bracket, between the legs of which the pivot pin is permanently mounted, the second hinge half consisting of a bracket portion and a clamping member, which by means of at least one fastener is releasably joined to the bracket portion, said bracket portion and clamping member being provided with facing and partially abutting surfaces and defining together a channel for receiving the pivot pin, characterized in that the facing surfaces of the bracket portion and the clamping member are mirror-symmetrical to each other and each comprise a substantially semicylindrical recess, said recesses forming the channel for the pivot pin, said pivot pin comprising a fixed pin and a rotatable but axially non-displaceable sleeve surrounding the pin and adapted to be securely but releasably clamped in the channel when the bracket portion and the clamping member are joined to each other.

2. Door hinge as claimed in claim 1, said bracket portion and clamping member terminating in free ends which, when said sleeve is clamped in the channel, are disposed on one side of said pivot pin, and screw means disposed on the side of said pivot pin opposite said one side and engaging with said bracket portion and clamping member in such a way that upon rotation of said screw means in one direction, said bracket portion and clamping member are moved toward each other to clamp said sleeve in the channel, and upon rotation in the opposite direction are moved away from each other to separate said free ends from each other by a distance sufficient to permit withdrawal of said sleeve from said channel by movement of said sleeve between said free ends.

* * * * *